US006488086B1

(12) United States Patent
Daragan et al.

(10) Patent No.: US 6,488,086 B1
(45) Date of Patent: Dec. 3, 2002

(54) METHOD OF THERMOCHEMICAL TREATMENT OF A PRODUCING FORMATION AND COMBUSTIBLE-OXIDIZING COMPOUND (COC) FOR REALIZING THE SAME

(76) Inventors: Evgeniy Venediktovich Daragan, ul. Volgina, 23-1-164, 117427, Moscow (RU); Evgeniy Nikolaevich Alexandrov, ul. Khabarovskaya, 18-1-140, 191589, Moscow (RU); Karina Grigorievna Scherbina, ul. Gv. Sheronintsev, 38V-20, Kharkov (UA); Gennadiy Panteleymonovich Domanov, ul. Smolnaya, 37-51, 125195, Moscow (RU); Eduard Borisovich Movshovich, Pr. Vernadskogo, 113-179, 117571, Moscow (RU)

( * ) Notice: Subject to any disclaimer, the term of this patent is extended or adjusted under 35 U.S.C. 154(b) by 14 days.

(21) Appl. No.: 09/644,462

(22) Filed: Aug. 23, 2000

(51) Int. Cl.[7] ..... E21B 29/02

(52) U.S. Cl. ..... 166/260; 166/262; 166/299; 166/300

(58) Field of Search ..... 166/256, 257, 166/260–262, 300, 299; 507/261, 266

(56) References Cited

U.S. PATENT DOCUMENTS

| | | | | | |
|---|---|---|---|---|---|
| 2,871,941 | A | * | 2/1959 | Allen et al. | 166/261 |
| 2,931,437 | A | * | 4/1960 | Smith | 166/262 |
| 5,573,307 | A | * | 11/1996 | Wilkinson et al. | 299/14 |

FOREIGN PATENT DOCUMENTS

| | | |
|---|---|---|
| GB | 2044793 | * 10/1980 |
| RU | 2064576 | 7/1996 |
| RU | 2126084 | 2/1999 |

* cited by examiner

*Primary Examiner*—David Bagnell
*Assistant Examiner*—Zakiya Walker
(74) *Attorney, Agent, or Firm*—Collard & Roe, P.C.

(57) ABSTRACT

Methods for thermochemically augmenting hydrocarbon inflow from a production formation increases the treatment efficacy in the oil and gas producing industry. A combustible oxidizing compound (COC) is pumped into the formation treatment zone and a combustion initiator is then introduced into the treatment zone. The combustion initiator is a solid or liquid compound on the base of a metal and/or metalloid hydride. In particular, salt hydrides such as alkaline metal boranes can be used.

7 Claims, 1 Drawing Sheet

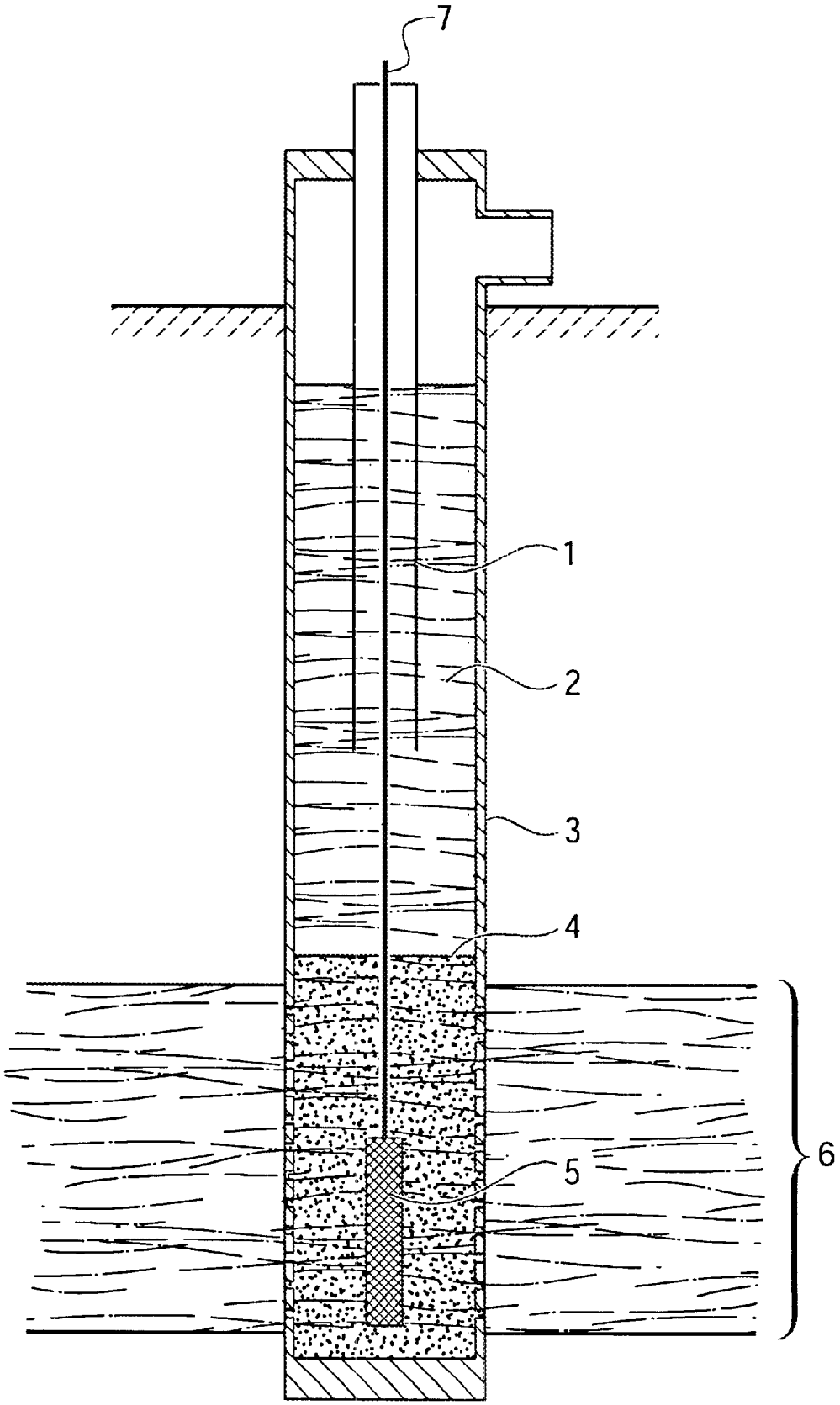
7
1
2
3
4
5
6

METHOD OF THERMOCHEMICAL TREATMENT OF A PRODUCING FORMATION AND COMBUSTIBLE-OXIDIZING COMPOUND (COC) FOR REALIZING THE SAME

BACKGROUND OF THE INVENTION

1. Field of the Invention

The invention group relates to methods of the thermochemically augmenting hydrocarbon inflow from a production formation while producing oil, gas and gas condensate in the oil industry.

2. Background of the Invention

Russian Patent No. RU 2064576 describes a well-known method of thermochemical treatment of production formation that includes pumping combustible-oxidizing compound (COC) into the formation treatment zone, where the COC contains ammonium nitrate, water, sal ammonia and/or dibasic ammonium phosphate, and introducing a combustion initiator into the COC zone, with the combustion initiator being a powder explosive charge. The prolonged treatment time, usage of the explosive and the rather complicated realization of the method restrict its applicability.

Another method described in Russian Patent No. RU 2126084 involves thermochemical treatment of the production formation that includes pumping-down the COC into the formation treatment zone and delivering the combustion initiator comprising a blend of metal aluminum and green rough into the treatment zone.

To implement this method, a COC is used that contains a complex compound of an amide such as carbamide and nitric acid, a compound with an acetate group such as acetic acid, potassium permanganate, fluid isopropylcarborane, water and ammonium nitrate.

SUMMARY OF THE INVENTION

The present invention proposes to provide a method of thermochemically treating a producing formation that increases treatment efficiency due to a fast forming of a large amount of hydrogen of high penetrability and to the increased energy-conversion efficiency of the process.

The invention comprises a thermochemical treatment of the producing formation, which includes pumping the combustible-oxidizing compound (COC) into the formation treatment zone and introducing the combustion initiator into the treatment zone. The combustion initiator comprises a solid or liquid composition on the base of a metal and/or metalloid hydride.

The liquid composition of the combustion initiator on the base of a metalloid hydride may be a suspension solution of a borane on the base of an organic dissolvent such as diethyl ether or methyl alcohol, at the following blending ratio, percent of total mass:

| | |
|---|---|
| Borane $LiBH_4$ and/or $NaBH_4$ and/or $KBH_4$ | 5–95 |
| Diethyl ether or methyl alcohol | 5–95. |

If the combustion initiator is on the base of metalloid hydride and has a solid composition, it may be a blend of a borane with alkali and/or solid isopropylcarborane at the following blending ratio, per cent of total mass:

| | |
|---|---|
| Borane $LiBH_4$ or/and $NaBH_4$ or/and $KBH_4$ | 60–95 |
| Alkali KOH or NaOH | 5–25 |
| Solid isopropylcarborane-$C_3B_8H_{14}$ | 5–40. |

The combustion initiator can be introduced by descending a hermetic container containing the combustion initiator into the tubing pipe string via an industrial hoist and then demolishing the container by detonating a backoff shot mounted along the entire container length after the terminations of the cord hoist contact the power source at the shoe of the tubing pipe string.

The fluid composition of the combustion initiator could be delivered to the treatment zone by pumping-down, in the following method:

First, the bottom of the tubing pipe string is sunk into the formation treatment zone;

Next, the consecutive pumping-down of the following chemicals occurs: combustion-oxidizing compound, dehydrated hydrocarbonaceous fluid, combustion initiator and extrusion liquid;

Then, the COC is pumped into the treatment zone by extrusion from the specified string and lifting the pipe string up to the top level of the COC;

The dehydrated hydrocarbonaceous fluid is pumped out;

The pipe string is sunk up to the middle of the work formation zone; and

The combustion initiator is pumped out of the specified pipe string directly to the COC.

If the bedding depth of the formation is less than 1200 m, the treatment zone is isolated by setting up packers at a distance of 45–55 m over the perforation zone of the casting tube.

The COC preferably contains a complex compound of an amide and nitric acid, a compound with an acetate group, potassium permanganate, isopropylcarborane, water and ammonium nitrate. The COC preferably contains an oxalic acid diamide as the amide and acetic ether of salicylic acid as the compound with acetate group, at the following blending ratio, percent of total mass:

| | |
|---|---|
| Complex compound of oxalic acid diamide and nitric acid | 18–36 |
| Acetic ether of salicylic acid | 4–5 |
| Potassium permanganate | 0.01–0.05 |
| Solid isopropylcarborane | 5–15 |
| Water | 9–18 |
| Ammonium nitrate | the rest. |

The COC can also contain calcium salicylate (0.05–1.5 percent of total mass) as a reaction retarder, and potassium chloride (0.001–0.005 percent of total mass), saccharose or glucose (0.05–3 percent of total mass) as a combustion stabilizer.

The metal hydrides in the combustion initiator contact water in the coc composition and immediately release a large amount of hydrogen of high penetrability, which penetrates at high speed into pores and cracks of the well, cleanses them by cracking and pyrolysis of asphaltic-gumming paraffin-hydrate compounds, and contributes to increasing old cracks and creating new ones. The posterior penetration of oxidizing gas into these pores results in the combustion process there. Therefore, the majority of the energy release occurs in pores and cracks of the formation, not in the very borehole, which greatly increases the efficiency of the thermochemical treatment.

Using the complex compound of oxalic acid diamide and nitric acid in the COC composition increases the energy-conversion efficiency of the COC due to the substitution of ammonium carbamide, (urea) for ammonium oxamide (oxalic acid diamide), and increases labor safety, as long as the ammonium carbamide binds the nitric acid to the more durable compound in the preparatory process.

Using an acetic ether of salicylic acid instead of acetic acid more effectively eliminates the detonation processes in the combustion.

The addition of solid isopropylcarborane to the COC composition homogenizes the combustion initiator composition and provides for an even energy emission directly in the work producing formation, and essentially augments the energetic potential of the initiating compound, including the energy share being consumed for hydrocarbon cracking.

BRIEF DESCRIPTION OF THE DRAWINGS

The drawing shows a pipe string in which the method according to the invention is carried out.

DETAILED DESCRIPTION OF THE PREFERRED EMBODIMENTS

The proposed method and composition provide for the substitution of detonation in the well for the fast combustion (for a few seconds) with no detonation. This time suffices for creating new cracks in the formation, but isn't enough for causing damage to the borehole rig.

The COC is prepared on the surface by blending components in the following proportions: water, oxalic acid diamide and concentrated nitric acid (54–68%). The oxalic acid diamide and concentrated nitric acid form a complex compound, and the nitric acid loses its corrosive characteristics and does not interact with the material of the oil-producing equipment. Then, the following components are added: potassium permanganate, isopropylcarborane and ammonium nitrate.

The potassium permanganate passivates the surface of the utilized equipment and boosts the composition enthalpy. The isopropylcarborane builds up the energetic potential of the COC, intensifies its combustibility and fosters the chain combustion processes and the stable interaction of the components. The acetic ether of salicylic acid stabilizes the composition components. Then, the calcium salicylate is loaded in the composition as a reaction retarder, and potassium chloride and saccharose and/or glucose are used as the reaction stabilizer.

| Components | Content, percent of total mass | | |
|---|---|---|---|
| | 1 | 2 | 3 |
| Complex compound of oxalic acid diamide and nitric acid | 18 | 28 | 36 |
| Acetic ether of salicylic acid | 4 | 4.5 | 5 |
| Potassium permanganate | 0.01 | 0.02 | 0.05 |
| Solid isopropylcarborane | 5 | 10 | 15 |
| Water | 9 | 15 | 18 |
| Calcium salicylate | 0.05 | 0.8 | 1.5 |
| Potassium chloride | 0.001 | 0.003 | 0.005 |

-continued

| Components | Content, percent of total mass | | |
|---|---|---|---|
| | 1 | 2 | 3 |
| Saccharose or glucose | 0.05 | 1.5 | 3 |
| Ammonium nitrate | | the rest | |

The method of thermochemical treatment of the producing formation is implemented in the following way as shown in the drawing: The Coc is pumped down into the treatment zone 6 through the tubing pipe string 1. Then the combustion initiator is delivered into the formation treatment zone 6. A solid or liquid (suspension) composition on the base of metal or metalloid hydride is used as the combustion initiator. Salt hydrides, such as alkaline metal boranes ($LiBH_4$, $NaBH_4$, $KBH_4$) that can be in both the solid and suspension state can be used.

In the last case, suspension solutions of alkaline metal boranes on the base of organic solvents-diethyl ether ($C_4H_{10}O$) or methyl alcohol ($CH_3OH$) may be used while the borane and dissolvent are each 5–95 percent of total mass.

Alkaline metal boranes being in the solid state (75–95 fraction of total mass) are found in the composition together with alkalis NaOH or KOH (5–25 percent of total mass). In the preparatory phase, the alkalis stabilize boranes in moist environment, and in the production phase, they augment the total heat effect at the expense of an exothermal hydrolysis reaction which provides for transferring the borane to the mode of thermal dissociation (T=400° C.).

A blend of alkaline metal borane and solid isopropylcarborane (5–40 percent of total mass) may be also used as the solid combustion initiator.

The machinery of the combustion initiator delivery avoids the expensive borehole cable, which is subject to breaks during detonation of the combustion initiator container 5, and is likely to cause an emergency after falling to the borehole bottom. An shown in the Figure, both the solid and the liquid combustion initiator can be delivered in a hermetic container 5 with an industrial hoist 7. The detonation of the combustion initiator container 5 is carried out by an explosion of a backoff shot, mounted along the entire container length. The explosion is initiated during the sinking of the container 5 by the contact or the terminations of the backoff shot with the power source (accumulator), mounted in the shoe of the tubing pipe string 1.

The liquid combustion initiator may be delivered to the treatment zone by pumping down into well 3. To prevent a possible deformation of the tubing pipe string 1, its bottom is equipped with aluminum pipes such as a shank, the length of which should exceed the perforation interval of the work formation.

The tubing pipe string 1 is sunk down to the bass of the perforation interval, and the following components are pumped in there in the calculated volumes: COC 4, dehydrated hydrocarbonaceous fluid (oil) 2, combustion initiator and extrusion water (e.g.: stratal water). Then the COC 4 is pumped out of the tubing pipe string 1 and is elevated up to the top level of the COC 4, settled in the borehole after pumping out from the tubing pipe string 1. Then the dehydrated hydrocarbonaceous fluid is pumped out of the tubing pipe string, which is sunk up to the middle of the work formation and the combustion initiator is pumped out from there into the COC medium, whereupon a fast combustion reaction begins.

When contacting water, the hydrides decay, emitting hydrogen and a large amount of heat. In the first phase of the combustion process, an intense heating takes place as well as an increase in pressure and the generation of intermediate burning gas-hydrogen, which penetrates into pores and cracks of the formation and contributes to creating new ones while affecting the formation fluids.

The second phase starts with the penetration of the oxidizing gas into pores and cracks and the generation of the combustible pair. The secondary local microexplosions in new cracks form new cracking centers in the well, creating links in the cracks, and they transform into the arterial ones, and thus enlarge the formation penetrability.

While the producing formation is being processed, a sharp wave may rise out of the spout, filling the well (a blow-out if the formation depth less than 1200–1500 m), which requires a considerable expense of energy, that is not related to the formation treatment. Because of a probable blowout, this method is not suitable for producing formations, the depths of which are less than 1200 m. To prevent this and corresponding decrease in influencing directly upon the work formation, the treatment zone is isolated by setting up a packer at a distance of 45–55 m over the perforation zone. This canalizes the prevailing part of the emitted energy for the work formation and will eliminate any limitations in depth of the bedding of the treatment zone.

INDUSTRIAL APPLICABILITY

The proposed method is effective, safe and may be used in any areas of oil and gas production for stimulating used-up wells and developing the new ones.

While only a few embodiments have been described, many modifications could be made thereto without departing from the spirit and scope of the invention.

What is claimed is:

1. A method of thermochemical treatment of a producing formation, comprising:

pumping a combustible-oxidizing compound (COC) into a treatment zone of the producing formation; and introducing a combustion initiator into the treatment zone, said combustion initiator being a solid or liquid composition having a base comprised of a metal hydride and/or a metal hydride of metalloid.

2. A method as claimed in claim 1, wherein the combustion initiator is a liquid composition and comprises a suspension solution of an alkaline metal borane on the base or an organic dissolvent selected from the group consisting of diethyl ether and methanol, at the following blending ratio, percent of total mass:

| | |
|---|---|
| borane-$LiBH_4$ and/or -$NaBH_4$ or -$KBH_4$ | 5–95 |
| diethyl ether or methanol | 5–95. |

3. A method as claimed in claim 2, wherein the combustion initiator is introduced to the treatment zone by pumping-down.

4. A method as claimed in claim 3, wherein the step of pumping down comprises:

sinking the bottom of a tubing pipe string into the treatment zone;

pumping-down the following chemicals: COC, dehydrated hydrocarbonaceous fluid, combustion initiator and extrusion liquid;

pumping the COC into the treatment zone by extrusion from the pipe string and lifting the pipe string up to a top level of the COC;

pumping out the dehydrated hydrocarbonaceous fluid, sinking a specified pipe string up to the middle of the treatment zone, and pumping the combustion initiator out of the specified pipe string directly to the COC.

5. A method as claimed in claim 4, wherein when a bedding depth of the well is lose than 1200 m, the treatment zone is isolated by setting up packers at a distance of 45–55 m over a perforation zone of a casing tube.

6. A method as claimed in claim 1, wherein the combustion initiator is a solid composition and comprises a blend of an alkaline metal borane with alkali and/or solid isopropylcarborane, at the following blending ratio, per cent of total mass:

| | |
|---|---|
| borane-$LiBH_4$ and/or -$NaBH_4$ and/or -$KBH_4$ | 60–95 |
| alkali-KOH or -NaOH | 5–25 |
| solid isopropylcarborane-$C_3B_8H_{14}$ | 5–40. |

7. A method as claimed in claim 1, wherein the combustion initiator is introduced by descending a hermetic container containing the combustion initiator into a tubing pipe string with an industrial hoist and then demolishing the container by detonating a backoff shot mounted along the entire container length after terminations of a cord hoist contact a power source at a shoe of the tubing pipe string.

* * * * *